United States Patent [19]

Zedalis et al.

[11] Patent Number: 4,946,500

[45] Date of Patent: Aug. 7, 1990

[54] ALUMINUM BASED METAL MATRIX COMPOSITES

[75] Inventors: Michael S. Zedalis, Randolph, N.J.; Paul S. Gilman, Suffern, N.Y.

[73] Assignee: Allied-Signal Inc., Morris Township, Morris County, N.J.

[21] Appl. No.: 242,987

[22] Filed: Sep. 12, 1988

Related U.S. Application Data

[63] Continuation-in-part of Ser. No. 142,103, Jan. 11, 1988, abandoned.

[51] Int. Cl.[5] ..... C22C 29/12

[52] U.S. Cl. ..... 75/232; 75/236; 75/244; 75/249; 419/10; 419/12; 419/13; 419/14; 419/19; 419/24; 419/32; 419/33

[58] Field of Search ..... 419/10, 12, 13, 14, 419/19, 24, 32, 33; 75/232, 236, 244, 249

[56] References Cited

U.S. PATENT DOCUMENTS

| | | | |
|---|---|---|---|
| 3,591,362 | 7/1971 | Benjamin | 75/0.5 BA |
| 4,594,222 | 6/1986 | Heck et al. | 420/529 |
| 4,624,705 | 11/1986 | Jatkar et al. | 419/17 |
| 4,722,751 | 2/1988 | Akechi et al. | 419/32 |
| 4,729,790 | 3/1988 | Skinner | 419/38 |
| 4,755,221 | 7/1988 | Paliwal et al. | 419/12 |

*Primary Examiner*—Stephen J. Lechert, Jr.
*Attorney, Agent, or Firm*—Ernest D. Buff; Gerhard H. Fuchs

[57] ABSTRACT

An aluminum based metal matrix composite is produced from a charge containing a rapidly solidified aluminum alloy and particles of a reinforcing material present in an amount ranging from about 0.1 to 50 percent by volume of the charge. The charge is ball milled energetically to enfold metal matrix material around each of the particles while maintaining the charge in a pulverulant state. Upon completion of the ball milling step, the charge is consolidated to provide a powder compact having a formable, substantially void free mass. The compact is especially suited for use in aerospace, automotive, electronic, wear resistance critical components and the like.

20 Claims, 3 Drawing Sheets

ALUMINUM BASED METAL MATRIX COMPOSITES

CROSS REFERENCE TO RELATED APPLICATIONS

This application is a continuation-in-part of application Ser. No. 142,103 filed Jan. 11, 1988, now abandoned.

BACKGROUND OF THE INVENTION

1. Field of the Invention

This invention relates to a process for improving the mechanical properties of metals, and more particularly to a process for producing an aluminum composite having a metal matrix and a reinforcing phase.

2. Description of the Prior Art

An aluminum based composite generally comprises two components —an aluminum alloy matrix and a hard reinforcing second phase. The composite typically exhibits at least one characteristic reflective of each component. For example, an aluminum based metal matrix composite should have the high ductility and fracture toughness of the aluminum matrix and the high elastic modulus of the reinforcing phase.

Aluminum based metal matrix composites containing particulate reinforcements are usually limited to ambient temperature applications because of the large mismatch in higher temperature strength between the aluminum matrix (low strength) and the particle reinforcement (high strength). Another problem with aluminum based metal matrix composites is the difficulty of producing a bond between the matrix and the reinforcing phase. To produce such a bond, it is often times necessary to vacuum hot press the material at temperatures higher than the incipient melting temperature of the matrix. It has been proposed that this technique be avoided by mechanically alloying the matrix with the addition of the particular reinforcement. This procedure, referred to as solid state bonding, permits the reinforcing phase to be bonded to the matrix without heating the material to a temperature above the solidus of the matrix. Prior processes in which aluminum based alloys and/or metal matrix composites are mechanically alloyed by means of solid state bonding are disclosed in U.S. Pat. Nos. 4,722,751, 4,594,222 and 3,591,362.

A major problem with solid state bonding of the particulate into the aluminum alloy matrix is the requirement that a processing aid be added to the powder to allow processing to take place. The processing aid, usually in the form of an organic wax such as stearic acid, must be broken down and the gaseous components removed therefrom by high temperature degassing. Such degassing operations involve prolonged exposure of the material to a temperature of 425° C. or more, degrading the material and limiting application of the material to temperatures below the degassing temperature.

SUMMARY OF THE INVENTION

The present invention provides a process for producing a composite material comprising the steps of forming a charge containing, as ingredients, a rapidly solidified aluminum alloy and particles of a reinforcing material such as a hard carbide, oxide, boride, carboboride, nitride or a hard intermetallic compound, the reinforcing material being present in an amount ranging from about 0.1 to 50 percent by volume of the charge, and ball milling the charge energetically to enfold metal matrix material around each of the reinforcing particles while maintaining the charge in a pulverulant state. In this manner there is provided a strong bond between the matrix material and the surface of the reinforcing particle. Upon completion of the ball milling step, the resultant powder is hot pressed or sintered using conventional powder metallurgical techniques, to form a powder compact having a mechanically formable, substantially void-free mass. The compressed and treated powder compact is then mechanically worked to increase its density and provide engineering shapes suitable for use in aerospace components such as stators, wing skins, missile fins, actuator casings, electronic housings and other wear resistance critical parts, automotive components such as piston heads, piston liners, valve seats and stems, connecting rods, cam shafts, brake shoes and liners, tank tracks, torpedo housings, radar antennae, radar dishes, space structures, sabot casings, tennis racquets, golf club shafts and the like.

BRIEF DESCRIPTION OF THE DRAWINGS

The invention will be more fully understood and further advantages will become apparent when reference is made to the following detailed description of the preferred embodiment of the invention and the accompanying drawings in which.

DESCRIPTION OF THE PREFERRED EMBODIMENTS

Figure 1A:
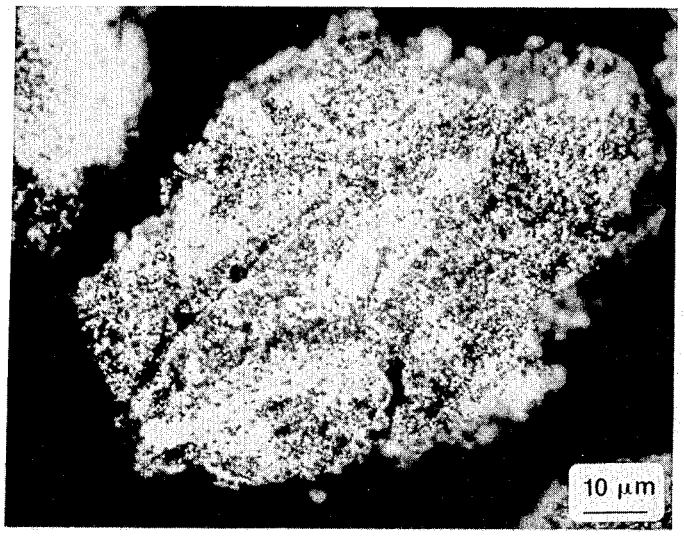
FIGS. 1A and 1B are photomicrographs of a rapidly solidified aluminum based iron, vanadium and silicon containing alloy powder having about 5 and 15 percent by volume silicon carbide particles substantially uniformly distributed therein in accordance with the present invention.

The aluminum base, rapidly solidified alloy appointed for use in the process of the present invention has a composition consisting essentially of the formula $Al_{bal}Fe_aSi_bX_c$ wherein X is at least one element selected from the group consisting of Mn, V, Cr, Mo, W, Nb, Ta, "a" ranges from 2.0 to 7.5 at %, "b" ranges from 0.5 to 3.0 at %, "c" ranges from 0.05 to 3.5 at % and the balance is aluminum plus incidental impurities, with the proviso that the ratio [Fe+X]:Si ranges from about 2.0:1 to 5.0:1. Examples of the alloy include aluminum-iron-vandium-silicon compositions wherein the iron ranges from about 1.5–8.5 at %, vanadium ranges from about 0.25–4.25 at %, and silicon ranges from about 0.5–5.5 at %.

Another aluminum base, rapidly solidified alloy suitable for use in the process of the invention has a composition consisting essentially of the formula $Al_{bal}Fe_aSi_bX_c$ wherein X is at least one element selected from the group consisting of Mn, V, Cr, Mo, W, Nb, Ta, "a" ranges from 1.5 to 7.5 at %, "b" ranges from 0.75 to 9.0 at %, "c" ranges from 0.25 to 4.5 at % and the balance is aluminum plus incidental impurities, with the proviso that the ratio [Fe+X]:Si ranges from about 2.01:1 to 1.0:1.

Still another aluminum base, rapidly solidified alloy that is suitable for use in the process of the invention has a composition range consists essentially of about 2–15 at % from a group consisting of zirconium, hafnium, titanium, vanadium, niobium, tantalum, erbium, about 0–5 at % calcium, about 0–5 at % germanium, about 0–2 at % boron, the balance being aluminum plus incidental impurities.

A low density aluminum-lithium base, rapidly solidified alloy suitable for use in the present process has a composition consisting essentially of the formula $Al_{bal}Zr_aLi_bMg_cT_d$, wherein T is at least one element selected from the group consisting of Cu, Si, Sc, Ti, B, Hf, Be, Cr, Mn, Fe, Co and Ni, "a" ranges from about 0.05–0.75 at %, "b" ranges from about 9.0–17.75 at %, "c" ranges from about 0.45–8.5 at % and "d" ranges from about 0.05–13 at %, the balance being aluminum plus incidental impurities. The aluminum matrix material must be provided as a particulate that can range in size from 0.64 cm in diameter down to less than 0.0025 cm in diameter. For the purposes of this specification and claims the term "hard", as applied to particles which may form the reinforcing phase of the resultant composite shall generally imply (1) a scratch hardness in excess of 8 on the Ridgway's Extension of the MOHS' Scale of Hardness, and (2) an essentially non-malleable character. However, for the aluminum matrices of this invention somewhat softer reinforcing particles such as graphite particles may be useful. Hard particles useful in the process of this invention include filamentary or non-filamentary particles of silicon carbide, aluminum oxide and/or aluminum hydroxide (including additions thereof due to its formation on the surface of the aluminum matrix material), zirconia, garnet, cerium oxide, yittria, aluminum silicate, including those silicates modified with flouride and hydroxide ions, silicon nitride, boron nitride, boron carbide, simple or mixed carbides, borides, carbo-borides and carbonitrides of tantalum, tungsten, zirconium, hafnium and titanium, and intermetallics such as $Al_3Ti$, AlTi, $Al_3$(V, Zr, Nb, Hf and Ta) $Al_7V$, $Al_{10}V$, $Al_3Fe$, $Al_6Fe$, $Al_{10}Fe_2Ce$, and $Al_{12}(Fe,Mo,V,Cr,Mn)_3Si$. In particular, because the present invention is concerned with aluminum based composites that possess a relatively low density and high modulus, silicon carbide and boron carbide are desirable as the reinforcing phase However, other particulate reinforcements may prove to form superior matrix/reinforcement bonds Also, the present specification is not limited to single types of reinforcement or single phase matrix alloys.

The term "energetic ball milling" in the context of the present specification and claims means milling at prescribed conditions where the energy intensity level is such that the hard reinforcing phase is optimately kneaded into the aluminum matrix. As used herein, the phrase "prescribed conditions" means conditions such that the ball mill is operated to physically deform, cold weld and fracture the matrix metal alloy powder so as to distribute the reinforcing phase therewithin. The phrase "optimately kneaded", as used herein, means that the reinforcing phase is distributed more uniformly than the distribution produced by simple mixing or blending, and approaches a substantially uniform and, most preferably, a substantially homogeneous distribution of reinforcing material within the matrix. Energetic ball mills include vibratory mills, rotary ball mills and stirred attritor mills. As opposed to mechanical alloying where special precautions must be taken so that cold welding of matrix particles into large agglomerates is minimized by the addition of processing aids, i.e., organic waxes such as stearic acid, the present specification and claims describe a process where energetic ball milling is carried out without the addition of any processing aids. The ability to process a fine and uniform dispersion of the reinforcing phase into the aluminum matrix is a direct consequence of starting with rapidly solidified aluminum alloys. Rapid solidification of those alloys is accomplished in numerous ways, including planar flow or jet casting methods, melt extraction, splat quenching, atomization techniques and plasma spray methods.

These metal alloy quenching techniques generally comprise the step of cooling a melt of the desired composition at a rate of at least about $10^{5°}$ C./sec. Generally, a particular composition is selected, powders or granules of the requisite elements in the desired portions are melted and homogenized, and the molten alloy is rapidly quenched on a chill surface, such as a rapidly moving metal substrate, an impinging gas or liquid.

When processed by these rapid solidification methods the aluminum alloy is manifest as a ribbon, powder or splat of substantially uniform structure. This substantially uniformly structured ribbon, powder or splat may then be pulverized to a particulate for further processing. By following this processing route to manufacture the aluminum matrix, the resulting aluminum particulate has properties that make it amenable to energetic ball milling to disperse the reinforcing phase without the addition of a processing control agent. These enhanced properties may include good room and elevated temperature strength and good fracture toughness. Furthermore, no processing aid is required, with the result that special degassing treatments heretofore employed to decompose the processing aid and out gas its gaseous components, are not necessary. Degassing sequences of the type eliminated by the process of the present invention are time and energy consuming. For if the residual processing aid required by prior milling process is not completely broken down and its gaseous components are not removed, the composite's properties may be adversely affected causing, for example, blistering of the composite upon exposure thereof to high temperatures. Further, with the present invention, introduction of residual elements such as carbon, from the processing aid, which can adversely affect properties of the final product are avoided.

After the reinforcement is completed, the resultant powder is compacted alone or mixed with additional matrix material under conditions conventionally used in the production of powder metallurgical bodies from the matrix material. Consequently, the resultant composite compact is vacuum hot pressed or otherwise treated under conditions typically employed for the matrix material, the conditions being such that no significant melting of the matrix occurs. Generally, the consolidation step is carried out at a temperature ranging from about 20 to 600° C., and preferably from about 250°to 550° C., the temperature being below the solidus temperature of the metal matrix. The Al-Fe-V-Si alloy composite containing silicon carbide reinforcements can be canless vacuum hot pressed at a temperature ranging from 275°to 475° C. and more preferably from 300°to 450° C., followed by forging or extrusion.

Those skilled in the art will appreciate that other time/temperature combinations can be used and that other variations in pressing and sintering can be employed. For example, instead of canless vacuum hot pressing the powder can be placed in metal cans, such as aluminum cans having a diameter as large as 30cm or more, hot degassed in the can, sealed therein under vacuum, and thereafter reheated within the can and compacted to full density, the compacting step being conducted, for example, in a blind died extrusion press. In general, any technique applicable to the art of powder metallurgy which does not invoke liquefying (melting) or partially liquefying the matrix metal can be used. Representative of such techniques are explosive compaction, cold isostatic pressing, hot isostatic pressing and direct powder extrusion. The resultant billet can then be worked into structural shapes by forging, rolling, extrusion, drawing and similar metal working operations.

EXAMPLE I

Figure 1B:
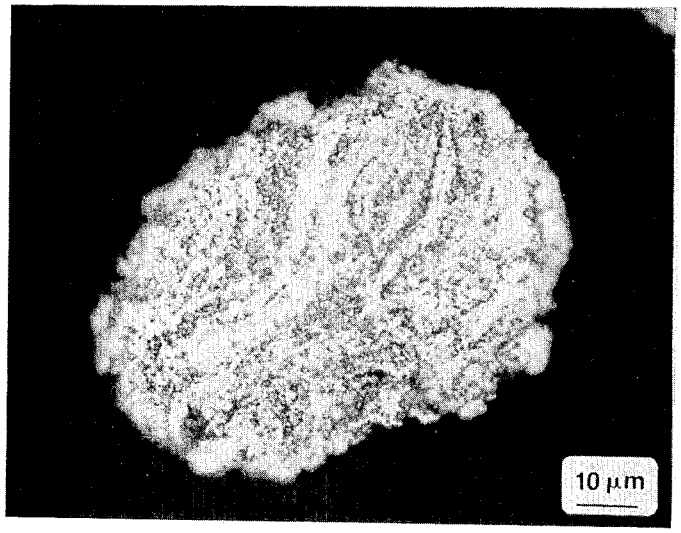

Five gram samples of −40 mesh (U.S. standard sieve) powder of the composition aluminum-balance, 4.06 at. % Iron, 0.70 at. % Vanadium, 1.51 at. % Silicon (hereinafter designated alloy A) was produced by comminuting rapidly solidified planar flow cast ribbon. The comminuted powder was added to either 0.28 grams or 0.94 grams of silicon particulate corresponding approximately to 5 and 15 volume percent particulate reinforcement, respectively. The samples were processed in sequence by pouring them into a Spex Industries hardened steel vial (model #8001) containing 31 grinding balls. Each of the balls had a diameter of about 0.365 cm and was composed of Alloy SAE 52100 steel. The filled vials were then sealed and placed into a Spex Industries 8000 Mixer Mill. Each powder batch containing 5 and 15 vol. percent SiC particulate was then processed for 60 and 120 minutes, respectively. No processing control agent such as stearic acid was used to control dispersion of the reinforcing phase. The processing procedure described above provides a composite aluminum-base alloy with silicon carbide particulate in the form of powder particles that exhibit a substantially uniform dispersion of reinforcement, and strong aluminum metal to silicon carbide particulate bonding. Photomicrographs of said composite powder particles containing 5 and 15 volume percent silicon carbide particulate that have been processed for 60 and 120 minutes, respectively, are shown in FIGS. 1A and 1B.

EXAMPLE II

Figure 2A:
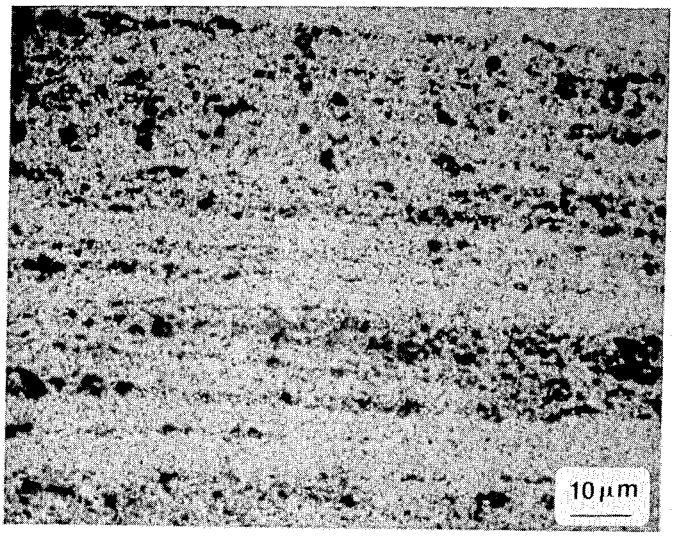
FIGS. 2A and 2B are photomicrographs of extruded aluminum based, iron, vanadium and silicon containing alloys containing, respectively, 5 and 15 volume percent silicon carbide particulate.
Figure 2B:
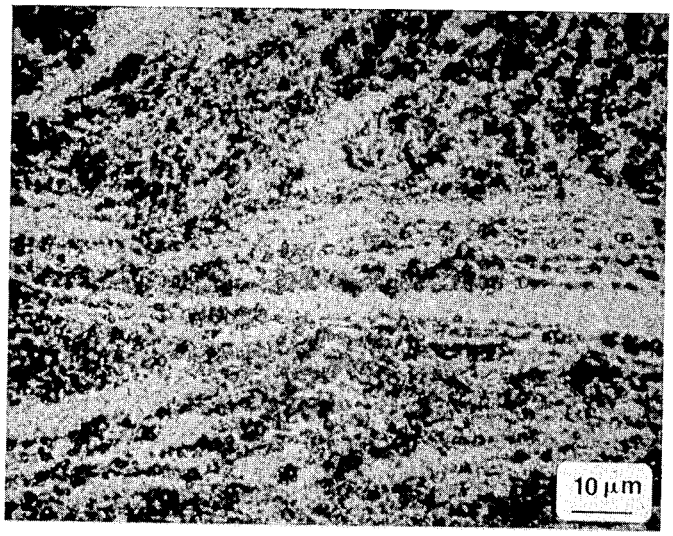

The procedure described in Example I was used to produce two 300 g batches of aluminum-based silicon carbide particulate composite powder particles. One of the batches contained 5 vol. percent silicon carbide particulate reinforcement and the other contained 15 vol. percent silicon carbide reinforcement. Each of the batches was then vacuum hot pressed into a billet having a diameter of 7.62 cm. The billets were heated to a temperature of 425° C. and extruded through alloy H-13 tool steel dies heated to a temperature of about 425° C. to form 1.59 cm diameter rods. As shown by the small dark spots in the photomicrographs of FIGS. 2*a* and 2*b*, for the 5 and 15 vol. % Silicon Carbide reinforced extrusion, respectively, the silicon carbide particulate reinforcement is extremely fine and is distributed substantially uniformly throughout the aluminum-base matrix. The fineness and substantial uniformity of particulate dispersion was not adversely affected or significantly enhanced by the extrusion.

EXAMPLE III

Rods produced in accordance with the procedure described in Example II were subjected to tensile tests at room temperature to determine their tensile properties, including values of 0.2 percent yield strength (Y.S.), ultimate tensile strength (U.T.S.), % elongation (ductility) and Young's modulus (E). Prior to testing, some of the tensile specimens had been exposed to temperatures of 425° C. for 100 hours to evaluate their thermal stability. Those tensile tests involving values of 0.2 percent yield strength, ultimate tensile strength and elongations were performed on an Instron Model 1125 tensile machine. Values of Young's modulus were measured by ultrasonic techniques described by A. Wolfenden in Acta Metallurgica, vol. 25, pp. 823–826 (1977) the disclosure of which is hereby incorporated by specific reference thereto, and represents a "dynamic" modulus. For comparison, rods were extruded from alloy A, i.e. a rapidly solidified, monolithic Aluminum base alloy having the same composition and method of preparation as that set forth in Examples I and II (except that no particulate reinforcement was present and the powder was not ball milled). The rods were subjected to tensile tests and evaluated for thermal stability in accordance with the procedure described above. The results of the tensile tests for rods containing particulate reinforcement are set forth in Table I, while results of tensile tests for monolithic rods containing no particulate reinforcement are set forth in Table II.

TABLE I

Tensile Properties and Young's Moduli For Extruded Rods of Aluminum-Base Material (i.e. Alloy A) Containing 5 and 15 Vol. percent SiC Particulate Reinforcement.

| Volume % SiC Particulate | Test Temp. (°C.) | Exposure Temp. (°C.) | Exposure Time (hrs) | Y.S. (MPa) | UTS (MPa) | E-long. (%) | E (GPa) |
|---|---|---|---|---|---|---|---|
| 5 | 25 | — | — | 376 | 436 | 9.0 | 93.7 |
| 5 | 25 | 425 | 100 | 360 | 420 | 4.5 | — |
| 15 | 25 | — | — | 385 | 504 | 2.3 | 108.1 |
| 15 | 25 | 425 | 100 | 393 | 507 | 1.8 | — |

TABLE II

Tensile Properties and Young's Moduli For Extruded Rods of Monolithic Aluminum-Base Material (i.e. Alloy A) Without SiC Particulate Reinforcement

| Vol. % SiC Particulate | Test Temp (°C.) | Exposure Temp (°C.) | Exposure Time (hrs) | Y.S. (MPa) | UTS (MPa) | E-long. (%) | E (GPa) |
|---|---|---|---|---|---|---|---|
| 0 | 25 | — | — | 390 | 437 | 10 | 88.4 |
| 0 | 25 | 425 | 100 | 385 | 440 | 11 | — |

As shown by the data of Tables I and II, the moduli of the 5 and 15 vol. percent silicon carbide reinforced rods are higher than that of the monolithic Aluminum-base alloy rods. The 5 vol. percent silicon carbide reinforced rods exhibited strength, ductility and thermal stability levels similar to the monolithic material, but, advantageously, exhibited a 6 percent increase in Young's modulus. When compared to the monolithic material, the 15 vol. percent silicon carbide reinforced rods exhibited comparable strength and thermal stability together with acceptable ductility; but exhibited a marked increase (i.e. 22%) in Young's moduli.

EXAMPLE IV

Rods produced in accordance with the procedure described in EXAMPLE II were subjected to elevated temperature testing to determine their high temperature mechanical properties. The rods were tested in accordance with the tensile and Young's modulus test procedures described in Example III. For comparative purposes, rods produced from monolithic aluminum base alloy A prepared in accordance with the procedure specified in Example III were also subjected to elevated temperature tensile and Young's Modulus tests. The results of the tests are set forth in Tables III and IV.

TABLE III

Elevated Temperature Tensile Properties and Young's Modulus for Extruded Rods of Rapidly Solidified Al-Base Alloy (i.e. Alloy A) Containing 5 and 15 Vol. % SiC Particulate Reinforcement

| Volume % $SiC_p$ | Test Temp °C. | Y.S. (MPa) | U.T.S. (MPa) | Elong. (%) | E (GPa) |
|---|---|---|---|---|---|
| 5 | 149 | 329 | 353 | 6.0 | 85 |
| 5 | 232 | 290 | 319 | 6.2 | 80 |
| 5 | 316 | 227 | 236 | 3.4 | 74 |
| 5 | 350 | — | — | — | 69 |
| 5 | 482 | — | — | — | 64 |
| 15 | 149 | 349 | 406 | 2.1 | 99 |
| 15 | 232 | 307 | 331 | 1.7 | 93 |
| 15 | 316 | 237 | 259 | 3.6 | 87 |
| 15 | 350 | — | — | — | 84 |
| 15 | 482 | — | — | — | 76 |

TABLE IV

Elevated Temperature Tensile Properties And Young's Modulus for Extruded Rods of Rapidly Solidified Monolitic Al-Base Alloy (i.e. Alloy A) Without SiC Particulate Reinforcement

| Volume % $SiC_p$ | Test Temp (°C.) | Y.S. (MPa) | UTS (MPa) | Elong. (%) | E (GPa) |
|---|---|---|---|---|---|
| 0 | 149 | 340 | 372 | 7 | 83 |
| 0 | 232 | 295 | 323 | 8 | 76 |
| 0 | 316 | 244 | 260 | 9 | 73 |
| 0 | 350 | — | — | — | 67 |
| 0 | 482 | — | — | — | 61 |

When compared to rods extruded from monolithic material, the 5 vol. percent silicon carbide reinforced rods produced in accordance with the present invention exhibited comparable strength and acceptable ductility at elevated temperatures, together with higher Young's Modulus. The 15 vol. percent silicon carbide reinforced rods, when thus compared, exhibited similar strengths and significantly higher Young's Modulus with somewhat lower ductility. Each of the 5 and 15 vol. % silicon carbide reinforced rods advantageously exhibited significantly higher levels of Young's Moduli and were markedly stiffer than the monolithic rods at elevated temperatures.

EXAMPLE V

Table V sets forth published data on material fabricated from prior art aluminum base alloys in which the particulate reinforcement was either blended into the powder, or ball milled thereinto using a processing control agent. As shown by the data, the material was subjected to tensile tests, the results of which are set forth in Table V.

TABLE V

Tensile Properties and Young's Moduli of Prior Art Aluminum Base Alloy Material Containing SiC Reinforcement.

| Alloy ID | Test Temperature (°C.) | Y.S. (MPa) | UTS (MPa) | Elong. (%) | E (GPa) |
|---|---|---|---|---|---|
| IN 9021 + 5 v/o $SiC_{(particulate)}$ | 25 | 550 | 613 | 3–5 | 79 |
| IN 9021 + 5 v/o $SiC_{(particulate)}$ | 150 | 516 | 534 | 4.5 | 26 |
| IN 9021 + 5 v/o $SiC_{(particulate)}$ | 230 | 160 | 220 | 26 | 62 |
| IN 9021 + 15 v/o $SiC_{(particulate)}$ | 25 | 580 | 627 | 2–3 | 103 |
| IN 9021 + 15 v/o $SiC_{(particulate)}$ | 150 | 550 | 606 | 4 | 89 |
| IN 9021 + 15 v/o $SiC_{(particulate)}$ | 230 | 172 | 241 | 26 | 74 |
| 2124-T6 + 20 v/o $SiC_{(whiskers)}$ | 25 | 504 | 638 | 0.8 | 121 |
| 2124-T6 + 20 v/o $SiC_{(whiskers)}$ | 150 | 500 | 618 | 1.1 | 118 |
| 2124-T6 + 20 v/o $SiC_{(whiskers)}$ | 230 | 277 | 324 | 3.0 | 87 |
| 2124-T6 + 20 v/o $SiC_{(whiskers)}$ | 315 | 80 | 91 | 11.6 | 61 |

When compared to the IN9021 aluminum alloy containing 5 vol. percent silicon carbide particulate produced by prior processing techniques, at room temperature the 5 vol. percent silicon carbide reinforced rods produced in accordance with the present invention exhibited acceptable strength and substantially greater ductility and Young's modulus (i.e., stiffness).

When compared to the IN9021 aluminum alloy containing 15 vol. percent silicon carbide particulate produced by prior processing techniques at room temperature the 15 vol. percent silicon carbide reinforced rods produced in accordance with the present invention exhibited acceptable strength, comparable ductility and favorable stiffness.

When compared to the 2124-T6 aluminum alloy containing 20 vol. percent silicon carbide whishers produced by prior processing techniques, the 15 vol. percent silicon carbide reinforced rods produced in accordance with the present invention exhibited acceptable strength, favorable ductility and comparable stiffness.

Figure 3:
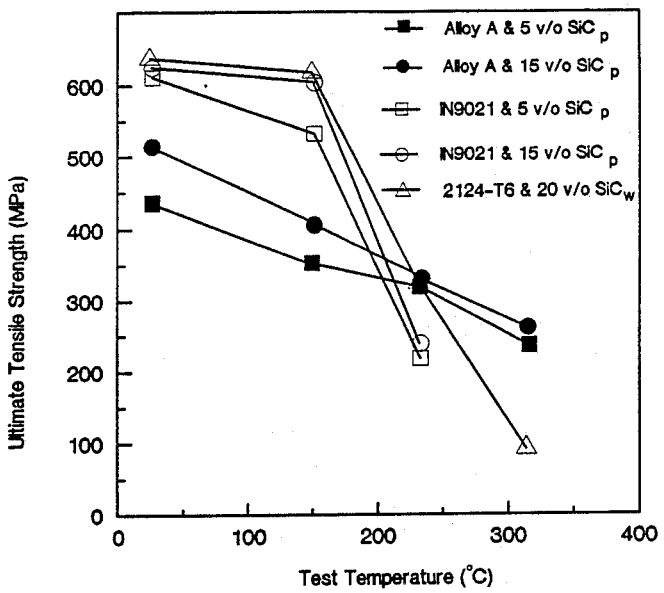
FIG. 3 is a graph depicting tensile properties as a function of temperature for extruded rods composed of the alloys of FIGS. 2A and 2B as contrasted with fabricated material composed of prior art alloys.
Figure 4:
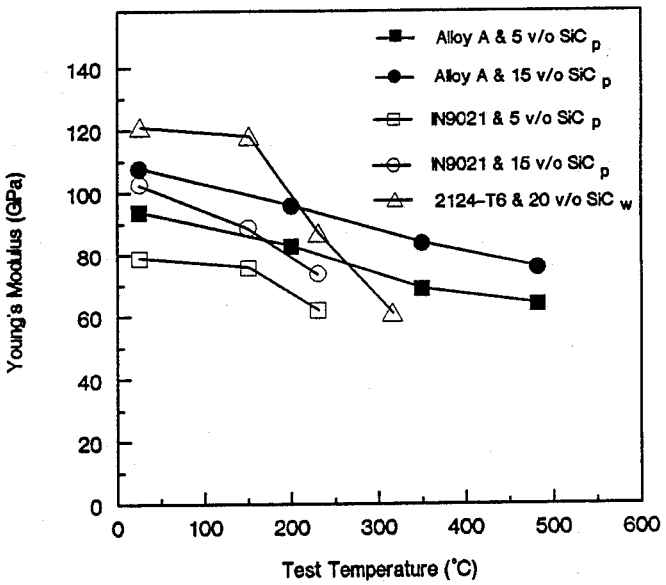
FIG. 4 is a graph in which Young's modulus as a function of temperature is depicted for the alloys shown in FIG. 3.

In FIGS. 3 and 4 of the drawings, there is provided a graphical comparison of mechanical and physical properties of material fabricated from alloys of the present invention and from prior art alloys. The graphs illustrated by FIGS. 3 and 4 depict tensile properties and Young's modulus as functions of temperature. At elevated temperatures, (above about 230° C.) the 5 and 15 vol. percent silicon carbide reinforced rods of the present invention exhibited improved strength, together with favorable ductility and substantially higher Young's Moduli, when compared to all silicon carbide reinforced aluminum alloys produced by prior processing technologies.

EXAMPLE VI

Five gram samples of −40 mesh (U.S. standard sieve) powder of the composition aluminum-balance, 4.33 at. % Iron, 0.73 at. % Vanadium, 1.72 at. % Silicon (hereinafter designated alloy B) was produced by comminuting rapidly solidified planar flow cast ribbon. The comminuted powder was added to either 0.26 grams or 0.88 grams of silicon nitride particulate corresponding approximately to 5 and 15 volume percent particulate reinforcement, respectively. The samples were processed in sequence by pouring them into a Spex Industries hardened steel vial (model #8001) containing 31 grinding balls. Each of the balls had a diameter of about 0.365 cm and was composed of Alloy SAE 52100 steel. The filled vials were then sealed and placed into a Spex Industries 8000 Mixer Mill. Each powder batch containing 5 and 15 volume percent $Si_3N_4$ particulate was then processed for 60 minutes. No processing control agent such as stearic acid was used to control dispersion of the reinforcing phase. The processing procedure described above provides a composite aluminum-base alloy with silicon nitride particulate in the form of powder particles that exhibit a substantially uniform dispersion of reinforcement, and strong aluminum metal to silicon nitride particulate bonding.

EXAMPLE VII

The procedure described in Example VI was used to produce two 3OO g batches of aluminum-based silicon nitride particulate composite powder particles. One of the batches contained 5 volume percent silicon nitride particulate reinforcement and the other contained 15 vol. percent silicon nitride reinforcement. Each of the batches was then vacuum hot pressed into a billet having a diameter of 7.62 cm. The billets were heated to a temperature of 425° C. and extruded through Alloy H-13 tool steel dies heated to a temperature of about 425° C. to form 1.59 cm diameter rods. The fineness and substantial uniformity of particulate dispersion was not adversely affected or significantly improved by the extrusion.

EXAMPLE VIII

Rods produced in accordance with the procedure described in Example VII were subjected to tensile tests at room temperature to determine their tensile properties, including values of 0.2 percent yield strength (Y.S.), ultimate tensile strength (U.T.S.), and % elongation (ductility). Those tensile tests involving values of 0.2 percent yield strength, ultimate tensile strength and elongations were performed on an Instron Model 1125 tensile machine. For comparison, rods were extruded from alloy B, i.e. a rapidly solidified, monolithic Aluminum base alloy having the same composition and method of preparation as that set forth in Examples VI and VII (except that no particulate reinforcement was present and the powder was not ball milled). The rods were subjected to tensile tests in accordance with the procedures described above. The results of the tensile tests for rods containing particulate reinforcement are set forth in Table VI, while results of tensile tests for monolithic rods containing no particulate reinforcement are set forth in Table VII.

TABLE VI

Tensile Properties For Extruded Rods of Aluminum-Base Material (i.e. Alloy B) Containing 5 and 15 Vol. percent Silicon Nitride Particulate Reinforcement.

| Volume % Particulate | Test Temp. (°C.) | Y.S. (MPa) | U.T.S. (MPa) | Elong. (%) |
|---|---|---|---|---|
| 5 | 25 | 538 | 563 | 6.7 |
| 15 | 25 | 578 | 621 | 0.6 |

TABLE VII

Tensile Properties For Extruded Rods of Monolithic Aluminum-Base Material (i.e. Alloy B) Without $Si_3N_4$ Particulate Reinforcement.

| Vol. % Particulate | Test Temp. (°C.) | Y.S. (MPa) | U.T.S. (MPa) | Elong. (%) |
|---|---|---|---|---|
| 0 | 25 | 413 | 448 | 10 |

As shown by the data of Table VI and VII, silicon nitride reinforced rods exhibited significantly higher strength, and ductility slightly lower than the monolithic alloy B material. Moreover, the 15 vol. percent silicon carbide reinforced rods exhibited acceptable ductility and a marked increase in tensile strength.

EXAMPLE IX

Rods produced in accordance with the procedure described in Example VII were subjected to elevated temperature testing to determine their high temperature mechanical properties. The rods were tested in accordance with the tensile test procedure described in Example VIII. For comparative purposes, rods produced from monolithic aluminum base alloy B prepared in accordance with the procedure specified in Example VIII were also subjected to elevated temperature tensile tests. The results of the tests are set forth in Tables VIII and IX.

TABLE VIII

Elevated Temperature Tensile Properties for Extruded Rods of Rapidly Solidified Al-Base Alloy (i.e. Alloy B) Containing 5 and 15 Vol. % $Si_3N_4$ Particulate Reinforcement.

| Volume % $Si_3N_4$ | Test Temp °C. | Y.S. (MPa) | U.T.S. (MPa) | Elong. (%) |
|---|---|---|---|---|
| 5 | 232 | 371 | 383 | 2.0 |
| 5 | 316 | 263 | 270 | 4.6 |
| 15 | 232 | 409 | 418 | .6 |
| 15 | 316 | 299 | 311 | 1.4 |

TABLE IX

Elevated Temperature Tensile Properties for Extruded Rods of Rapidly Solidified Monolitic Al-Base Alloy (i.e. Alloy B) Without $Si_3N_4$ Particulate Reinforcement

| Volume % $Si_3N_4$ | Test Temp (°C.) | Y.S. (MPa) | U.T.S. (MPa) | Elong. (%) |
|---|---|---|---|---|
| 0 | 149 | 345 | 372 | 9 |
| 0 | 232 | 300 | 310 | 12 |
| 0 | 316 | 241 | 241 | 13 |

When compared to rods extruded from monolithic material, the 5 vol. percent silicon nitride reinforced rods produced in accordance with the present invention exhibited increased strength and acceptable ductility at elevated temperatures. The 15 vol. percent silicon nitride reinforced rods, when thus compared, exhibit market increases in strengths with somewhat lower ductility.

EXAMPLE X

Table V sets forth published data on material fabricated from prior art aluminum base alloys in which the particulate reinforcement was either blended into the powder, or ball milled thereinto using a processing control agent. As shown by the data, the material was subjected to tensile tests, the results of which are set forth in Table V.

When compared to the IN9021 aluminum alloy containing 5 vol. percent silicon carbide particulate produced by prior processing techniques, at room temperature the 5 vol. percent silicon nitride reinforced rods produced in accordance with the present invention (Table VI) exhibit comparable strength and greater ductility.

When compared to the IN9021 aluminum alloy containing 5 vol % silicon carbide particulate produced by prior processing techniques, at elevated temperatures the 5 vol. % silicon nitride reinforced rods produced in accordance with the present invention (Table VIII) exhibits substantially greater strength and acceptable levels of ductility.

When compared to the IN9021 aluminum alloy containing 15 vol. percent silicon carbide particulate produced by prior processing techniques, at room temperature the 15 vol. percent silicon nitride reinforced rods produced in accordance with the present invention (Table VI) exhibited acceptable strength and comparable ductility.

When compared to the IN9021 aluminum alloy containing 15 vol.% silicon carbide particulate product by prior processing techniques, at elevated temperatures the 15 vol. % silicon nitride reinforced rods produced in accordance with the present invention (Table VIII) exhibit substantially greater strength and acceptable levels of ductility.

When compared to the 2124-T6 aluminum alloy containing 20 vol. percent silicon carbide whiskers produced by prior processing techniques (Table V), at elevated temperatures, the 15 vol. percent silicon nitride reinforced rods produced in accordance with the present invention (Table VIII) exhibited superior strength and comparable ductility.

EXAMPLE XI

Five gram samples of −40 mesh (U.S. standard sieve) powder of the composition aluminum-balance, 10.82 at. % Lithium 0.14 at % Zirconium, 0.39 at. % Copper and 0.51 at. % Magnesium (hereinafter designated alloy C) was produced by comminuting rapidly solidified planar flow cast ribbon. The comminuted powder was added to either 0.34 grams or 1.13 grams of silicon carbide particulate corresponding approximately to 5 and 15 volume percent particulate reinforcement, respectively. In addition, comminuted powder without any silicon carbide reinforcements was selected for subsequent processing. The samples were processed in sequence by pouring them into a Spex Industries hardened steel vial (model #8001) containing 31 grinding balls. Each of the balls had a diameter of about 0.365 cm and were composed of Alloy SAE 52100 steel. The filled vials were then sealed and placed into a Spex Industries 8000 Mixer Mill. Each powder batch containing 0, 5 and 15 vol. percent SiC particulate was then processed for 90 minutes. No processing control agent such as stearic acid was used to control dispersion of the reinforcing phase. The processing procedure described above provides a composite aluminum-lithium base alloy with silicon carbide particulate in the form of powder particles that exhibit a substantially uniform dispersion of reinforcement, and strong aluminum metal to silicon carbide particulate bonding.

EXAMPLE XII

The procedure described in Example XI was used to produce three 300 g batches of monolithic aluminum-lithium based alloy and silicon carbide particulate reinforced aluminum-lithium based composite powder particles. Specifically batches contained 0, 5 and 15 vol. percent silicon carbide particulate reinforcement. Each of the batches was then vacuum hot pressed into a billet having a diameter of 7.62 cm. The billets were heated to a temperature of 350° C. and extruded through alloy H-13 tool steel dies heated to a temperature of about 350° C. to form 1.59 cm diameter rods. The fineness and substantial uniformity of particulate dispersion was not adversely affected or substantially increased by the extrusion.

EXAMPLE XIII

Rods produced in accordance with the procedure described in Example XII were subjected to a solutionizing heat treatment, 2 hours at 550° C., and age hardened by conventional heat treatment for monolithic aluminum-lithium based alloys to achieve peak hardness, 16 hrs at 130° C., as reported by Kim et al., "Structure and Properties of Rapidly Solidified Aluminum-Lithium Alloys", J. de Physique, C3, 9 48, p. 309, Sept. 1987, and then tensile tested at room temperature to determine their tensile properties, including values of 0.2 percent yield strength (Y.S.), ultimate tensile strength (U.T.S.) and % elongation (ductility). Those tensile tests involving values of 0.2 percent yield strength, ultimate tensile strength and elongations were performed on an Instron Model 1125 tensile machine. For comparison, rods were extruded from alloy C, i.e. a rapidly solidified, monolithic aluminum-lithium based alloy having the same composition and method of preparation as that set forth in Examples XI and XII (except that no particulate reinforcement was present and the powder was not ball milled). These rods were solutionized by aging for 2 hours at 550° C., and peak aged by heating for 16 hours at 130° C., and then subjected to tensile tests in accordance with the procedures described above. The results of the tensile tests for rods containing particulate reinforcement in the solutionized and peak aged condition are set forth in Table X, while results of tensile tests for monolithic rods containing no particulate reinforcement, in the un-ball milled and ball milled conditions are set forth in Table XI.

TABLE X

Tensile Properties For Extruded Rods of Aluminum-Lithium Based Material (i.e. Alloy C) Containing 5 and 15 vol. percent SiC Particulate Reinforcement.

| Volume % SiC Particulate | Test Temp. (°C.) | Aging Condition | Y.S. (MPa) | U.T.S. (MPa) | Elong. (%) |
|---|---|---|---|---|---|
| 5 | 25 | solutionized* | 392 | 467 | 6.5 |
| 5 | 25 | peak aged** | 485 | 524 | 1.7 |
| 15 | 25 | solutionized* | 470 | 502 | 0.5 |
| 15 | 25 | peak aged** | 592 | 606 | 0.2 |

*Solutionized - 2 hours at 550° C.

**Peak aged - conventional 16 hours at 130° C.

TABLE XI

Tensile Properties for Extruded Rods of Monolithic Aluminum-Lithium Based Material (i.e., Alloy C) in the Un-Ball Milled and Ball Milled Conditions Without SiC Particulate Reinforcement.

| Condition | Test Temp. (°C.) | Aging Condition | Y.S. (MPa) | U.T.S. (MPa) | Elong (%) |
|---|---|---|---|---|---|
| Un-Ball Milled | 25 | solutionized* | 233 | 356 | 6 |
| Un-Ball Milled | 25 | peak-aged** | 417 | 451 | 2 |
| Ball Milled | 25 | solutionized* | 312 | 384 | 11 |
| Ball Milled | 25 | peak-aged** | 535 | 537 | 2.5 |

*Solutionized - 2 hours. at 550° C.
**Peak-aged - 16 hours at 130° C.

As shown by the data of Tabled X and XI, the 5 and 15 percent SiC particulate reinforced rods, in both the as-solutionized and peak-aged conditions, exhibit significantly increased levels of strength and comparable ductility when compared to the monolithic material in either the un-ball milled and ball-milled conditions. When compared to the 5 volume percent SiC particulate reinforced material, the 15 volume percent SiC particulate reinforced alloy exhibited superior levels of strength and acceptable levels of ductility. When compared to the un-ball milled monolithic material, the ball milled monolithic alloy exhibit increased levels of strength and ductility.

Having thus described the invention in rather full detail, it will be understood that such detail need not be strictly adhered to but that further changes and modifications may suggest themselves to one skilled in the art, all falling within the scope of the invention as defined by the subjoined claims.

We claim:

1. A process for producing a composite having a metal matrix and a reinforcing phase, comprising the steps of:

(a) forming a charge containing, as ingredients, a rapidly solidified aluminum based alloy and particles of a reinforcing material present in an amount ranging from about 0.1 to 50 percent by volume of said charge;

(b) ball milling the charge energetically to enfold metal matrix material around each of said particles while maintaining the charge in a pulverulant state said ball milling step being carried out without addition of a processing aid; and (c) consolidating said charge to provide a mechanically formable, substantially void-free mass.

2. A process as recited in claim 1, wherein said rapidly solidified aluminum based alloy has a substantially uniform structure.

3. A process as recited in claim 2, wherein said rapidly solidified aluminum based alloy is prepared by a process comprising the steps of forming a melt of the aluminum based alloy and quenching the melt on a moving chill surface at a rate of at least about $10^{5}$° C./sec.

4. A process as recited in claim 3, wherein said ball milling step is continued until said particles are enveloped in and bonded to said matrix material.

5. A process as recited in claim 4, wherein said consolidation step is carried out at a temperature ranging from about 250° to 550° C., said temperature being below the solidus temperature of said metal matrix.

6. A process as recited in claim 5, wherein said consolidation step comprises vacuum hot pressing at a temperature ranging from about 275° to 475° C.

7. A process as recited in claim 3, wherein said rapidly solidified aluminum based alloy has a composition consisting essentially of the formula $Al_{bal}Fe_aSi_bX_c$ wherein X is at least one element selected from the group consisting of Mn, V, Cr, Mo, W, Nb, Ta, "a" ranges from 2.0 to 7.5 at %, "b" ranges from 0.5 to 3.0 at %, "c" ranges from 0.05 to 3.5 at % and the balance is aluminum plus incidental impurities, with the proviso that the ratio [Fe+X]:Si ranges from about 2.0:1 to 5.0:1.

8. A process as recited in claim 7, wherein said rapidly solidified aluminum based alloy is selected from the group consisting of the elements Al-Fe-V-Si, wherein the iron ranges from about 1.5–8.5 at %, vanadium ranges from about 0.25–4.25 at %, and silicon ranges from about 0.5–5.5 at %.

9. A process as recited in claim 3, wherein said rapidly solidified aluminum based alloy has a composition consisting essentially of the formula $Al_{bal}Fe_aSi_bX_c$ wherein X is at least one element selected from the group consisting of Mn, V, Cr, Mo, W, Nb, Ta, "a"-ranges from 2.5 to 7.5 at %, "b" ranges from 0.75 to 9.0 at %, "c" ranges form 0.25 to 4.5 at % and the balance is aluminum plus incidental impurities, with the proviso that the ratio [Fe+X]:Si ranges from about 2.01:1 to 1.0:1.

10. A process as recited in claim 3, wherein said rapidly solidified aluminum based alloy has a composition consisting essentially of about 2–15 at % from a group consisting of zirconium, hafnium, titanium, vanadium, niobium, tantalum, erbium, about 0–5 at % calcium, about 0–5 at % germanium, about 0–2 at % boron, the balance being aluminum plus incidental impurities.

11. A process as recited in claim 3, wherein said rapidly solidified aluminum based alloy is selected from the group consisting essentially of the formula $Al_{bal}Zr_aLi_bMg_cT_d$, wherein T is at least one element selected from the group consisting of Cu, Si, Sc, Ti, B, Hf, Be, Cr, Mn, Fe, Co and Ni, "a" ranges from about 0.05–0.75 at %, "b" ranges from about 9.0–17.75 at %, "c" ranges from about 0.45–8.5 at % and "d" ranges from about 0.05–13 at. %, and the balance being aluminum plus incidental impurities.

12. A process as recited in claim 4, wherein said particles are selected from the group consisting of carbides, borides, nitrides, oxides and intermetallic compounds.

13. A process as recited in claim 12, wherein said particles are selected from the group consisting of silicon carbide and boron carbide particles.

14. A process as recited in claim 4, wherein said particles of reinforcing material are substantially uniformly distributed within said matrix material.

15. A composite produced in accordance with the process recited by claim 1.

16. A composite having at least 50 percent matrix material formed from a rapidly solidified aluminum based alloy, said matrix material having substantially uniformly distributed therein particles of a reinforcing material and having been enfolded around each of said particles without addition of a processing aid.

17. A composite as recited in claim 16, wherein said reinforcing material is present in an amount ranging 15 percent by volume.

18. A composite as recited in claim 16, having the form of a powder.

19. A composite as recited in claim 16, having the form of a consolidated, mechanically formable, substantially void-free mass.

20. A composite as recited in claim 17, wherein said mass is selected from the group consisting of extrusions, forgings, rolled sheets or plates and drawn wire or tubes.

* * * * *